US008276345B2

(12) United States Patent
Brady

(10) Patent No.: US 8,276,345 B2
(45) Date of Patent: Oct. 2, 2012

(54) JAMB STUD CONNECTOR AND METHOD OF USE THEREOF

(76) Inventor: Todd A. Brady, Beverly Hills, CA (US)

( * ) Notice: Subject to any disclaimer, the term of this patent is extended or adjusted under 35 U.S.C. 154(b) by 215 days.

(21) Appl. No.: 12/777,192

(22) Filed: May 10, 2010

(65) Prior Publication Data

US 2011/0271614 A1 Nov. 10, 2011

(51) Int. Cl.
*E04C 3/09* (2006.01)
*E04C 3/32* (2006.01)

(52) U.S. Cl. ..... 52/839; 52/836; 52/653.2; 52/241; 52/843

(58) Field of Classification Search ..... 52/839, 52/836, 653.2, 241, 844, 845, 848, 849, 850, 52/838, 843
See application file for complete search history.

(56) References Cited

U.S. PATENT DOCUMENTS

| | | | | | |
|---|---|---|---|---|---|
| 523,075 | A | * | 7/1894 | Krause | 52/838 |
| 588,290 | A | * | 8/1897 | Poindexter | 52/838 |
| 1,344,229 | A | * | 6/1920 | Hutchinson | 110/199 |
| 1,420,473 | A | | 6/1922 | Dawson | |
| 2,589,304 | A | * | 3/1952 | Spangler | 52/574 |
| 2,930,665 | A | * | 3/1960 | Budai | 312/111 |
| 3,156,331 | A | * | 11/1964 | Sklar | 52/215 |
| 3,190,410 | A | * | 6/1965 | Molstad | 52/843 |
| 3,222,833 | A | | 12/1965 | Woodrum | |
| 3,445,977 | A | * | 5/1969 | Latiano | 52/713 |
| 3,552,085 | A | | 1/1971 | Woodrum | |
| 3,593,473 | A | | 7/1971 | King | |
| 3,945,167 | A | | 3/1976 | Wendt | |
| 4,614,068 | A | | 9/1986 | Bergthold | |
| 4,720,957 | A | * | 1/1988 | Madray | 52/846 |
| 4,993,095 | A | * | 2/1991 | Lautensleger et al. | 14/74.5 |
| 5,800,896 | A | * | 9/1998 | Kobayashi | 428/67 |
| 5,802,800 | A | * | 9/1998 | Meyers | 52/847 |
| 5,931,474 | A | * | 8/1999 | Chang et al. | 277/316 |
| 6,079,181 | A | * | 6/2000 | Ruff | 52/745.15 |
| 7,155,874 | B2 | * | 1/2007 | Lee | 52/843 |
| 2006/0096201 | A1 | | 5/2006 | Daudet | |

FOREIGN PATENT DOCUMENTS

| | | | |
|---|---|---|---|
| DE | 3509466 | A1 * | 8/1986 |
| DE | 3529135 | A1 * | 2/1987 |

* cited by examiner

*Primary Examiner* — Phi Dieu Tran A
(74) *Attorney, Agent, or Firm* — Trojan Law Offices

(57) ABSTRACT

A device and method for providing a support for framing an opening. The device comprises generally a first stud, a second stud, and a connector to form a jamb stud connection assembly. Each of the first stud and the second stud comprises a web, a pair of flanges, and a pair of returns. The connector comprises an elevation, a pair of side flanges, and a pair of terminal flanges. The first stud and the second stud are secured together by the connector such that the elevation of the connector is flush with and attached to the web of the first stud, and the terminal flanges of the connector are flush with and attached to the web of the second stud. The jamb stud connection assembly may be vertically installed inside a wall adjacent to the opening.

19 Claims, 8 Drawing Sheets

JAMB STUD CONNECTOR AND METHOD OF USE THEREOF

BACKGROUND OF THE INVENTION

1. Field of the Invention

The invention herein relates to a device and method for providing a support for framing an opening.

2. Background Information

For framing openings for doors or other similar structures at a construction site, it is known that a web of a metal stud must face the opening for mounting a door or other similar structure desired. In many cases, these openings must have double studs for additional support. Conventionally, the studs have been either tied together with straps or welded together. Straps cause bulging that complicates the addition of drywall. Multiple straps are needed along the entire length of the studs, which adds materials and labor costs to the project. Alternatively, welding is expensive, time consuming, presents fire hazards, and requires special inspections. Similar to straps, multiple welds are required along the entire length of the two studs.

SUMMARY OF THE INVENTION

A jamb stud connection assembly for providing a support for framing an opening comprises generally a first stud, a second stud, and a connector. Each of the first stud and the second stud comprises a web, a pair of flanges, and a pair of returns. Each of the flanges extends substantially perpendicularly from the web, and the returns extend inwardly from the flanges such that the returns are substantially parallel to the web. The connector comprises an elevation, a pair of side flanges, and a pair of terminal flanges. The side flanges extend from the elevation, and the terminal flanges extend outwardly from the side flanges such that the terminal flanges are substantially parallel to the elevation. The first stud and the second stud are connected and secured together by the connector such that the elevation of the connector is flush with and attached to the web of the first stud, and the terminal flanges of the connector are flush with and attached to the web of the second stud. When the first stud and the second stud are secured together by the connector, the returns of the first stud are flush with the returns of the second stud. The jamb stud connection assembly may be vertically installed inside a wall adjacent to the opening.

DETAILED DESCRIPTION OF THE INVENTION

Figure 1:
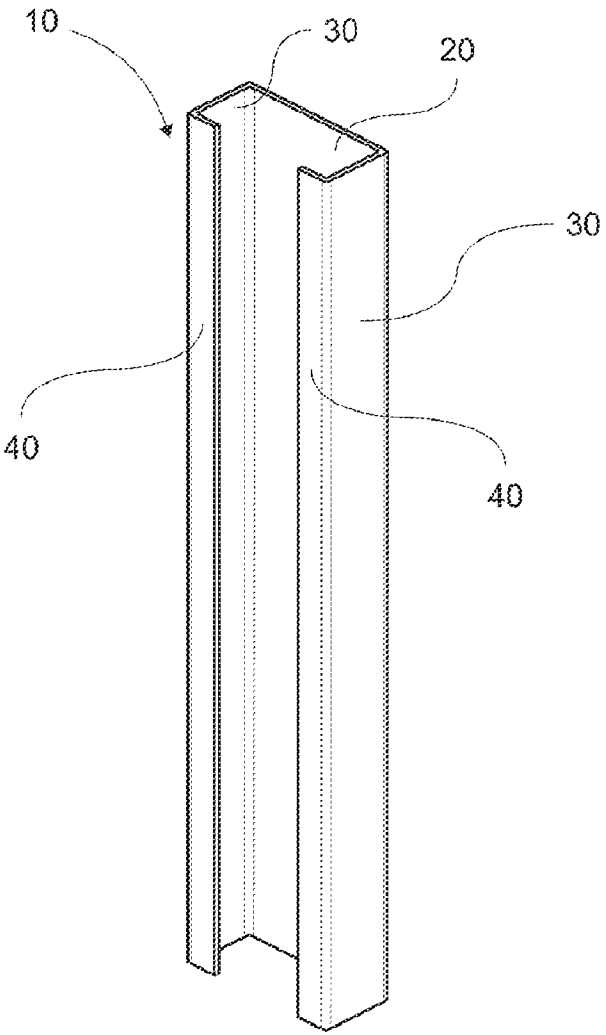
FIG. 1 is a perspective view of an embodiment of a stud.

FIG. 1 illustrates an embodiment of a stud to be used in a jamb stud connection assembly in accordance with the present invention. A stud 10 comprises a web 20, a pair of flanges 30, and a pair of returns 40. Each of the flanges 30 extends substantially perpendicularly from the web 20, and the returns 40 extend inwardly from the flanges 30 such that the returns 40 are substantially parallel to the web 20. The length of the stud 10 may vary depending on the vertical length of a space where the stud will be positioned.

Figure 2A:
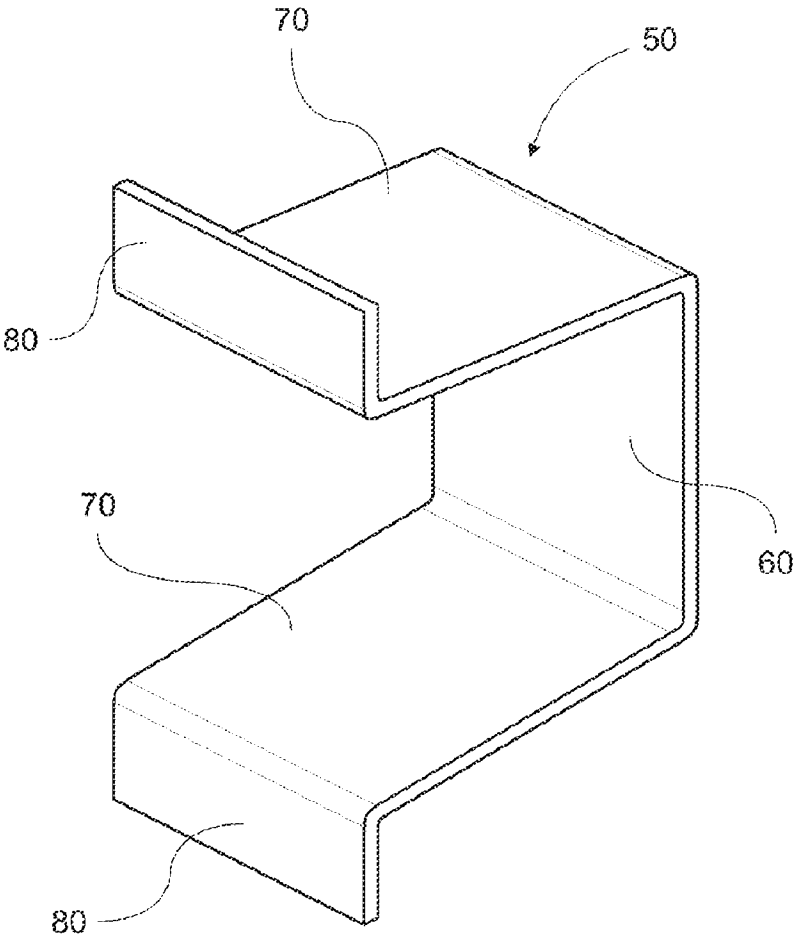
FIG. 2A is a perspective view of an embodiment of a connector in accordance with the present invention.
Figure 2C:
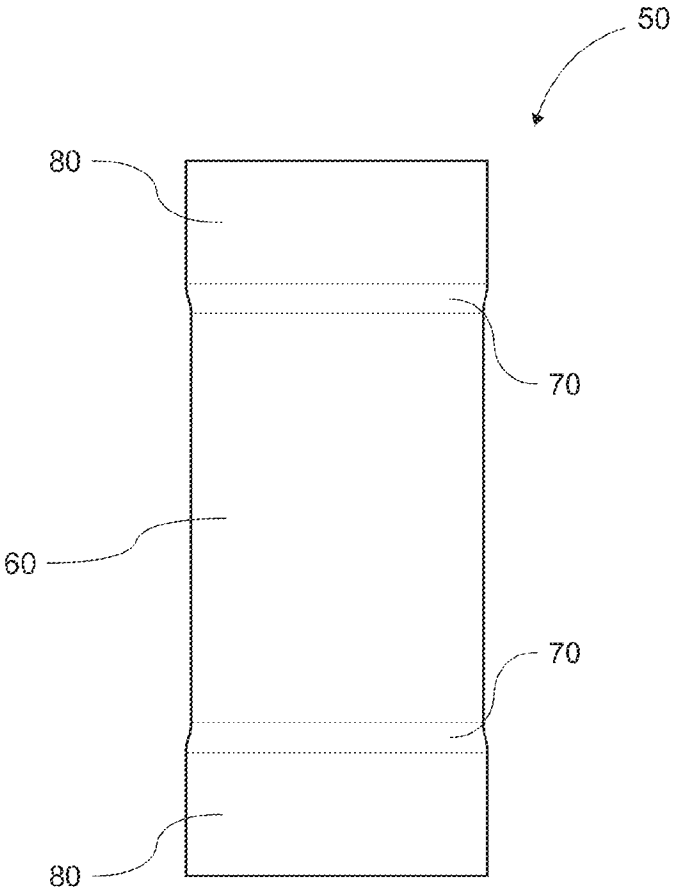
FIG. 2C is a front view of the connector shown in FIG. 2A.
Figure 2B:
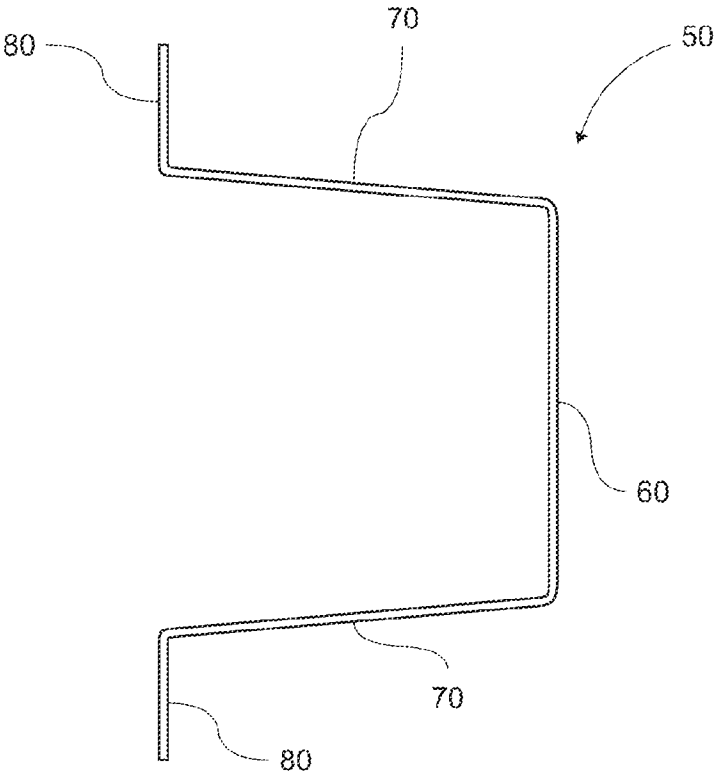
FIG. 2B is a side view of the connector shown in FIG. 2A.
Figure 3A:
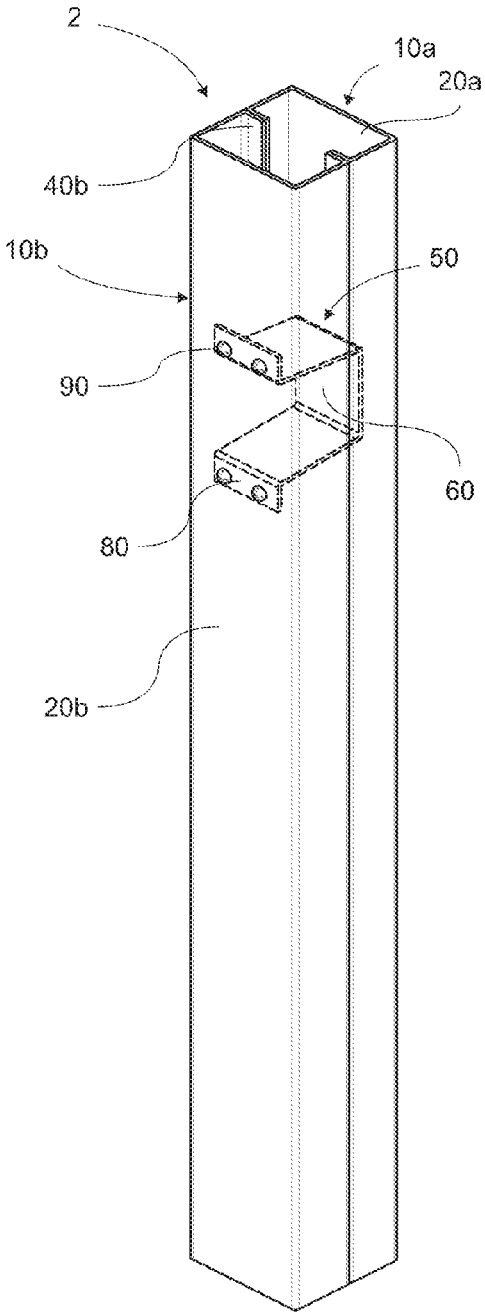
FIG. 3A is a front perspective view of an embodiment of a jamb stud connection assembly in accordance with the present invention, in which a connector is shown in phantom by broken lines.
Figure 3B:
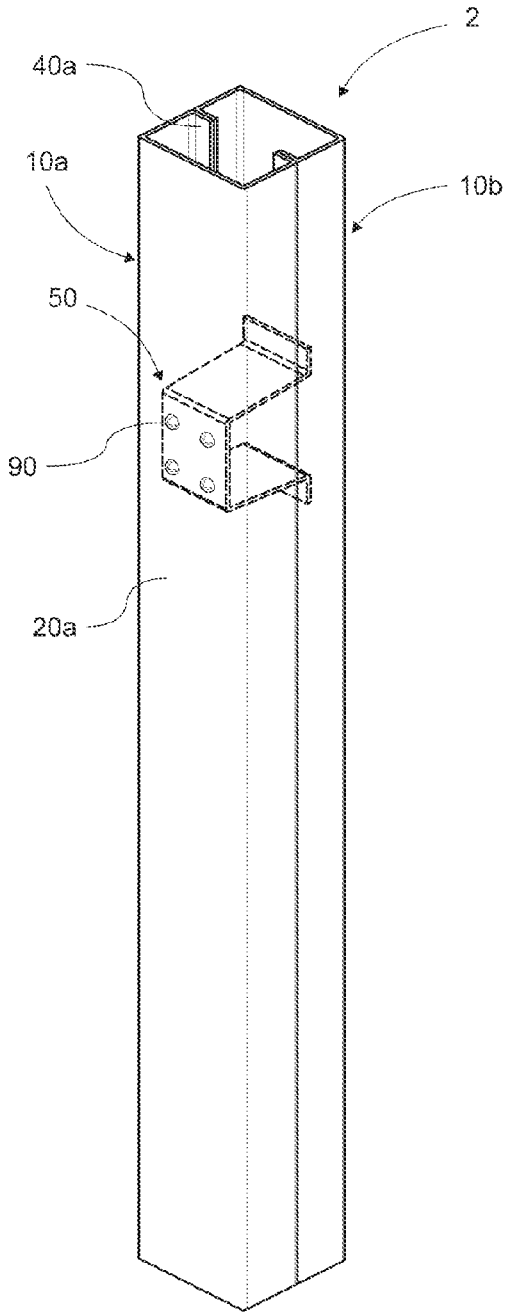
FIG. 3B is a rear perspective view of the jamb stud connection assembly shown in FIG. 3A, in which the connector is shown in phantom by broken lines.
Figure 3D:
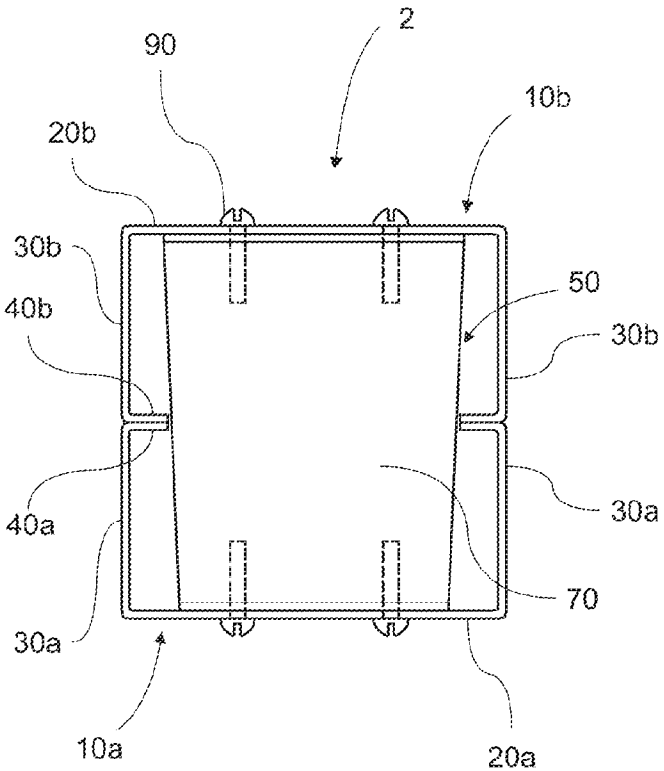
FIG. 3D is a top view of the jamb stud connection assembly shown in FIG. 3A.
Figure 3C:
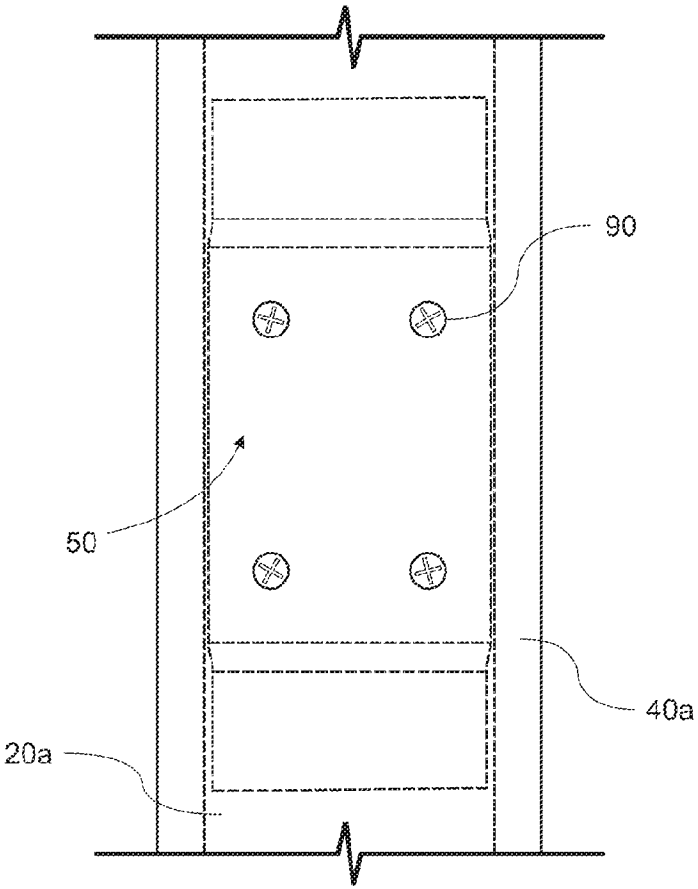
FIG. 3C is a rear view of the jamb stud connection assembly shown in FIG. 3A, in which the connector and a pair of returns of a stud are shown in phantom by broken lines.

FIGS. 2A through 2C illustrate an embodiment of a connector in accordance with the present invention. A connector 50 comprises an elevation 60, a pair of side flanges 70, and a pair of terminal flanges 80. The side flanges 70 extend from the elevation 60, and the terminal flanges 80 extend outwardly from the side flanges 70 such that the terminal flanges 80 are substantially parallel to the elevation 60. The side flanges 70 of the connector 50 may extend outwardly diagonally from the elevation 60 as shown in FIG. 2B.

Figure 6:
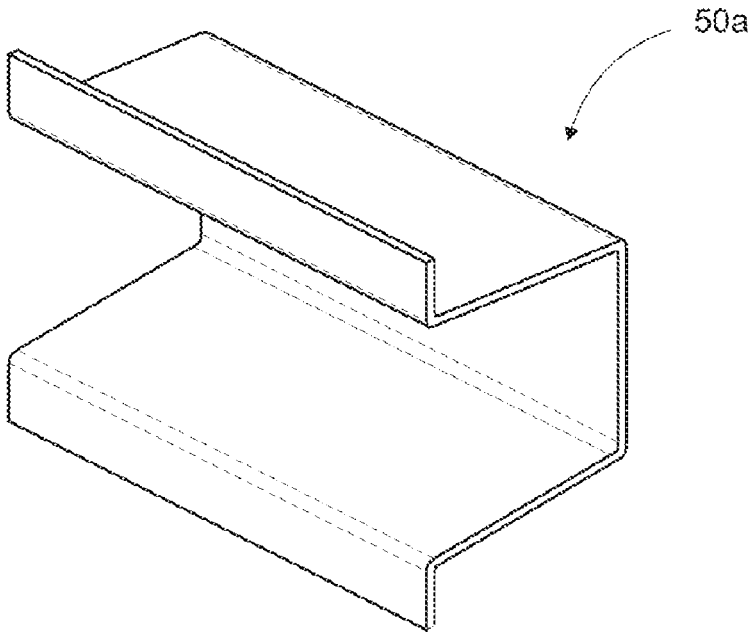
FIG. 6 shows another embodiment of a connector in accordance with the present invention.
Figure 7:
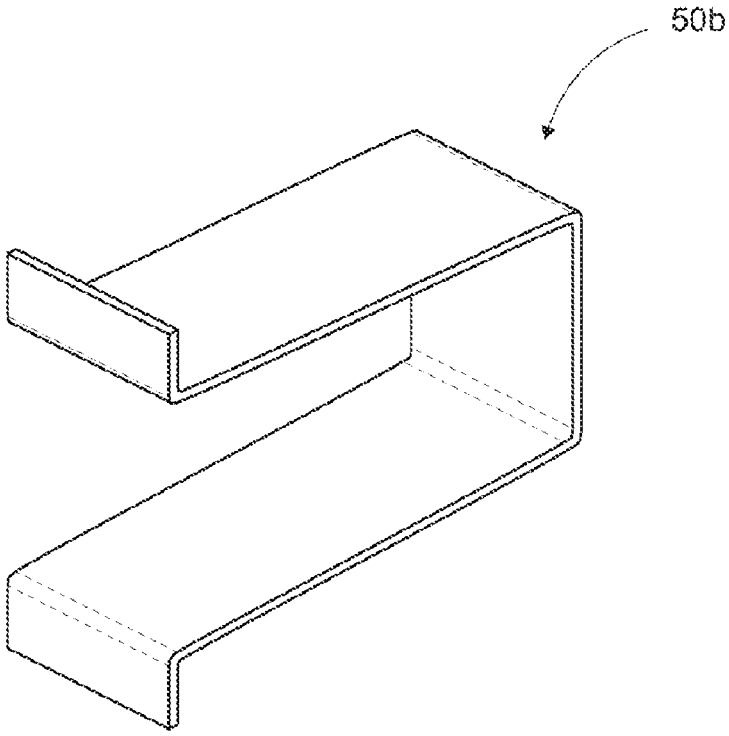
FIG. 7 shows still another embodiment of a connector in accordance with the present invention.

A connector in accordance with the present invention may vary in dimensions such as length, width, and/or height. The dimensions of a connector may vary depending on dimensions of studs to be joined by the connector. FIGS. 6 and 7 show examples of different embodiments of connectors, 50*a* and 50*b*, that are different in dimensions.

FIGS. 3A through 3D illustrate an embodiment of a jamb stud connection assembly in accordance with the present invention. The jamb stud connection assembly 2 comprises a connector 50 and two studs, 10*a* and 10*b*. The first stud 10*a* and the second stud 10*b* are connected and secured together by the connector 50 such that the elevation 60 of the connector 50 is flush with and attached to the web 20*a* of the first stud 10*a* by one or more screws 90, and the terminal flanges 80 of the connector 50 are flush with and attached to the web 20*b* of the second stud 10*b* by screws 90. Because the webs, 20*a* and 20*b*, are the strongest portions of the studs, 10*a* and 10*b*, securing the studs together at their webs creates a much stronger connection than any known connecting methods. When the first stud 10*a* and the second stud 10*b* are joined together by the connector 50, the returns 40*a* of the first stud 10*a* are flush with the returns 40*b* of the second stud 10*b*. When the first stud 10*a* and the second stud 10*b* are joined together by the connector 50, the connector 50 may be located within the studs, 10*a* and 10*b*, such that the side flanges 70 of the connector 50 are substantially perpendicular to the flanges, 30*a* and 30*b*, of the studs, 10*a* and 10*b*, as shown in FIGS. 3A through 3D. In another embodiment, the connector 50 may be located within the studs, 10*a* and 10*b*, such that one of the side flanges 70 of the connector 50 is placed near one of the returns 40*a* of the first stud 10*a* and the other side flange 70 of the connector 50 is placed near the other return 40*a* of the first stud 10*a* so as not to block the open space formed between the two studs, 10*a* and 10*b*.

Figure 4A:
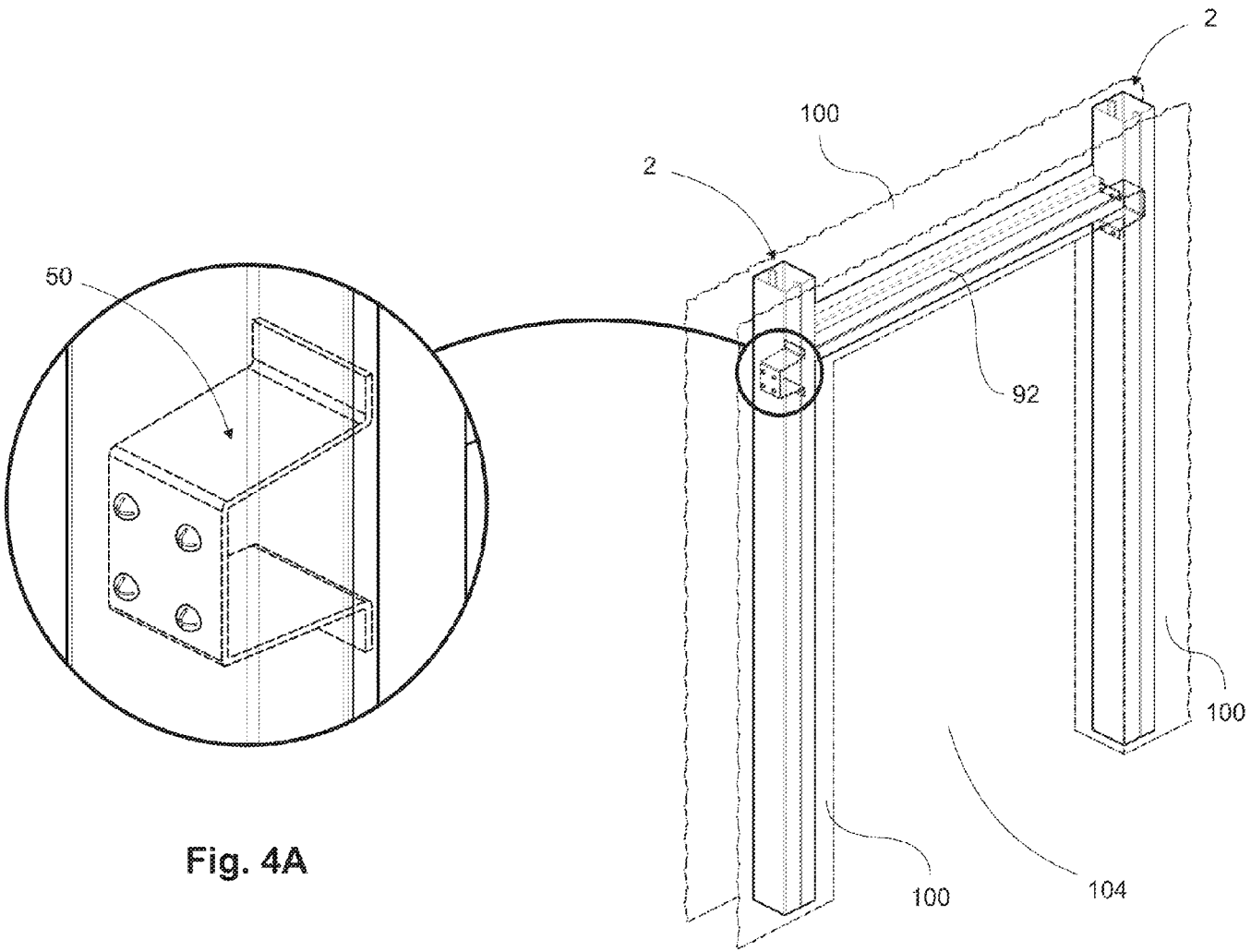
FIG. 4A illustrates a use of a jamb stud connection assembly in accordance with the present invention for providing a support for framing an opening, wherein the jamb stud connection assembly is installed inside a wall.
Figure 4C:
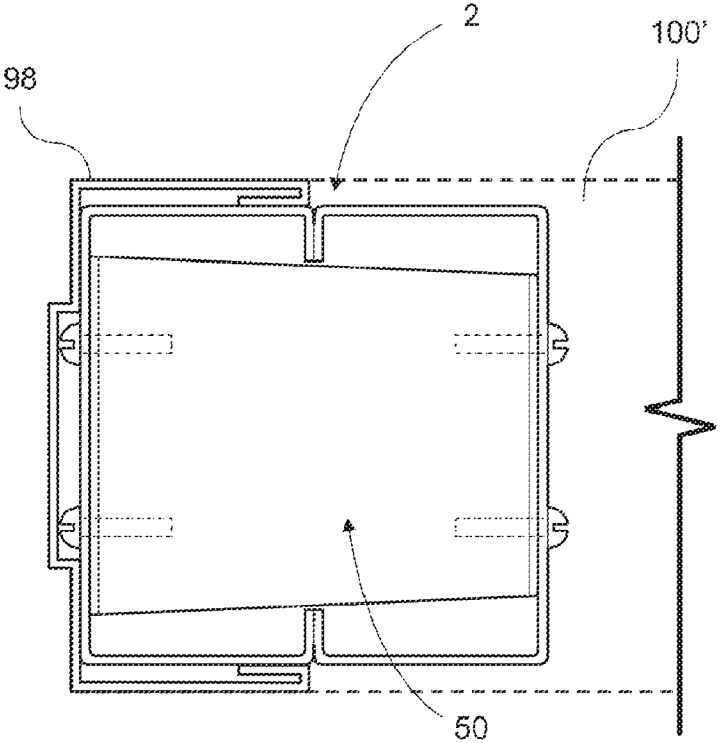
FIG. 4C is a cross-sectional top view of a jamb stud connection assembly installed inside a wall and engaging a door frame.
Figure 4B:
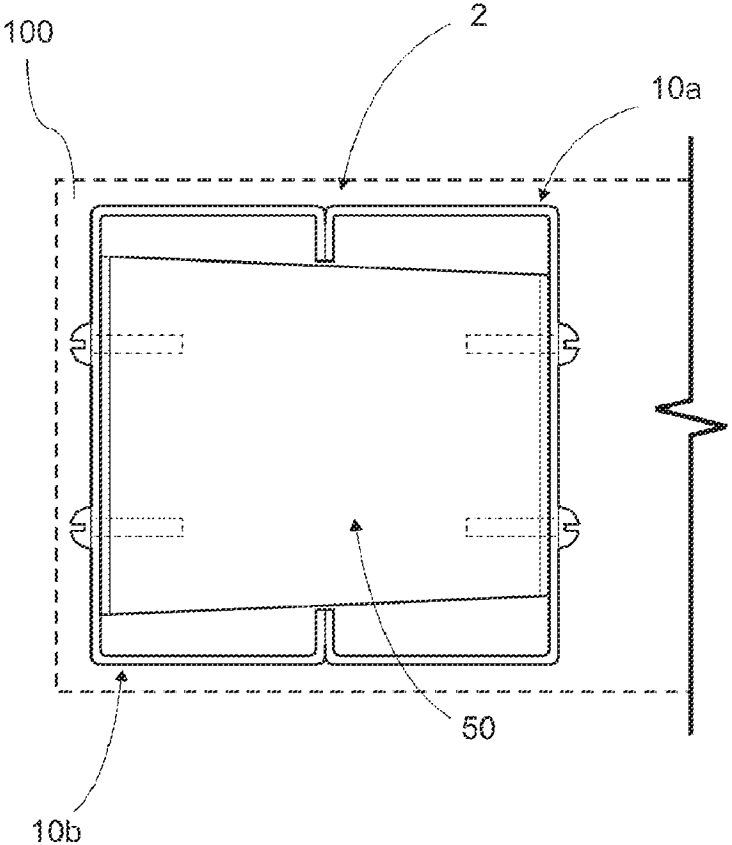
FIG. 4B is a cross-sectional top view of the jamb stud connection assembly, which is installed inside a wall.
Figure 5:
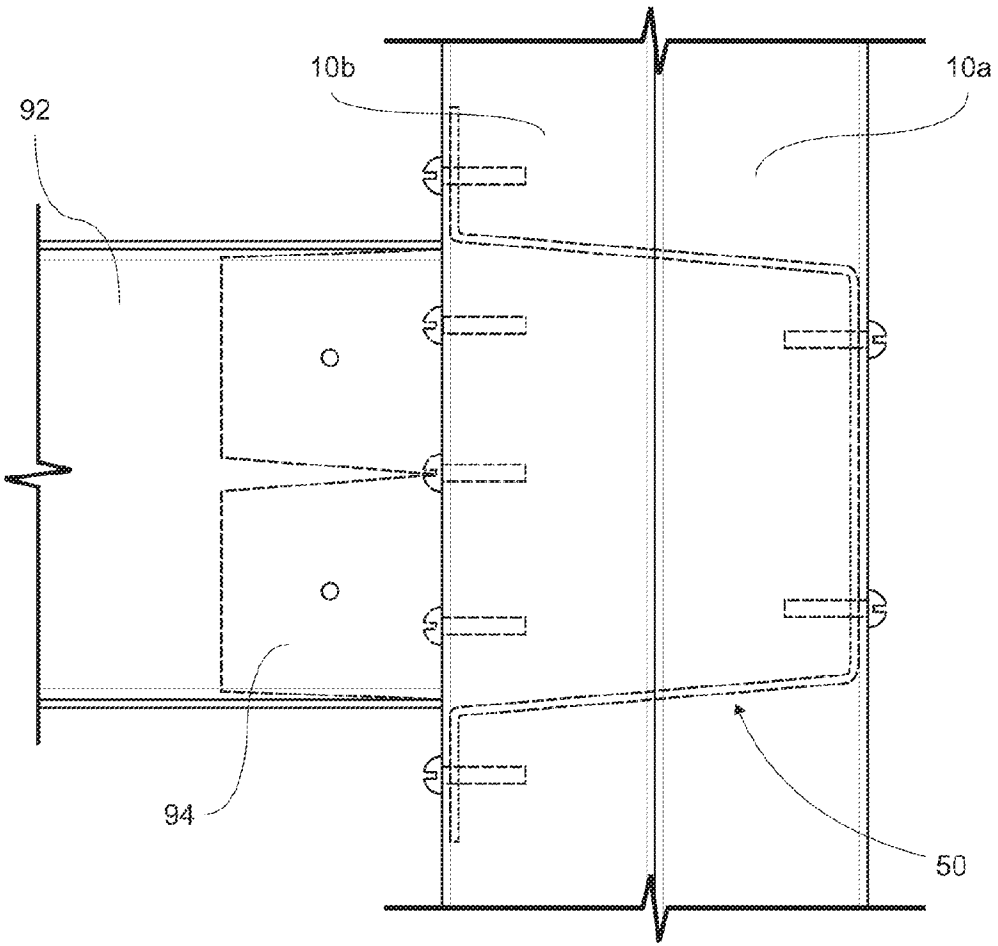
FIG. 5 shows a jamb stud connection assembly with a header attached thereto in accordance with the present invention, in which a connector is shown in phantom by broken lines.

FIGS. 4A through 4C illustrate that a jamb stud connection assembly in accordance with the present invention is used for providing a support for framing an opening. An example of such opening is an opening for a door. FIGS. 4A and 4B show that the jamb stud connection assembly 2 comprising a connector 50 and two studs, 10*a* and 10*b*, is installed vertically inside a wall 100 adjacent to the opening 104. Only one connector 50 may be needed to join the two studs, 10*a* and 10*b*, together. As shown in FIG. 4A, to support for framing an opening, a pair of jamb stud connection assemblies are vertically installed, and a header 92 is horizontally connected to and in-between the jamb stud connection assemblies. As illustrated in FIGS. 4A and 5, the connector 50 of each jamb stud connection assembly 2 secures the first stud 10*a* and the second stud 10*b* together at the point where the header 92 is attached to the jamb stud connection assembly. The header 92 is for supporting a weight of a structure located above. The point where the header 92 is attached to the jamb stud connection assembly 2 is the point at which the greatest load is located. By placing the connector 50 at the point where the greatest load is located, only one connector 50 can be used to secure the two studs, 10*a* and 10*b*, together for each jamb stud connection assembly.

The header 92 may be attached to the jamb stud connection assembly 2 through a bracket 94 by screws. In particular, as shown in FIGS. 4A and 5, the header 92 may be attached to the second stud 10*b* of the jamb stud connection assembly 2 through a bracket 94 placed on the second stud 10*b*. In another embodiment, the header 92 may be attached to the first stud 10*a* of the jamb stud connection assembly 2 through a bracket placed on the first stud 10*a*.

FIG. 4C illustrates that a jamb stud connection assembly in accordance with the present invention is used for supporting a door frame. FIG. 4C shows that the jamb stud connection assembly 2 is vertically installed inside the wall 100' and engages a door frame 98.

While the said detailed description elaborates workable embodiments of the present invention, the said embodiments shall not be construed as a limitation on the patented scope and claims of the present invention and, furthermore, all equivalent adaptations and modifications based on the technological spirit of the present invention shall remain protected within the scope and claims of the invention herein.

What is claimed is:

1. A jamb stud connection assembly comprising:

a first stud comprising a web, a pair of flanges, and a pair of returns, each of the flanges extending substantially perpendicularly from the web, the returns extending inwardly from the flanges such that the returns are substantially parallel to the web;

a second stud comprising a web, a pair of flanges, and a pair of returns, each of the flanges of the second stud extending substantially perpendicularly from the web of the second stud, the returns of the second stud extending inwardly from the flanges of the second stud such that the returns of the second stud are substantially parallel to the web of the second stud; and a connector comprising an elevation, a pair of side flanges, and a pair of terminal flanges, the side flanges extending from the elevation, the terminal flanges extending outwardly from the side flanges such that the terminal flanges are substantially parallel to the elevation, wherein the first stud and the second stud are connected and secured together by the connector such that the returns of the first stud are flush with the returns of the second stud, the elevation of the connector is flush with and attached to the web of the first stud, and the terminal flanges of the connector are flush with and attached to the web of the second stud.

2. The jamb stud connection assembly of claim 1, wherein the elevation of the connector is attached to the web of the first stud by a screw, and the terminal flanges of the connector are attached to the web of the second stud by screws.

3. The jamb stud connection assembly of claim 1, wherein the side flanges of the connector are substantially perpendicular to the flanges of the first stud when the first stud and the second stud are connected by the connector.

4. The jamb stud connection assembly of claim 1, wherein the side flanges of the connector extends outwardly diagonally from the elevation.

5. The jamb stud connection assembly of claim 1, wherein the number of the connector needed for securing the first stud and the second stud is only one.

6. The jamb stud connection assembly of claim 1, wherein the connector secures the first stud and the second stud together at the point where a header is attached to one of the first stud and the second stud.

7. The jamb stud connection assembly of claim 1 further comprising a header for supporting a weight of a structure located above, the header attached to the second stud, the connector securing the first stud and the second stud together at the point where the header is attached to the second stud.

8. The jamb stud connection assembly of claim 1, wherein the jamb stud connection assembly is installed inside a wall for supporting a door frame.

9. A method of connecting jamb studs, which comprises:

providing a first stud, a second stud, and a connector, the first stud comprising a web, a pair of flanges and a pair of returns, each of the flanges extending substantially perpendicularly from the web, the returns extending inwardly from the flanges such that the returns are substantially parallel to the web, the second stud comprising a web, a pair of flanges and a pair of returns, each of the flanges of the second stud extending substantially perpendicularly from the web of the second stud, the returns of the second stud extending inwardly from the flanges of the second stud such that the returns of the second stud are substantially parallel to the web of the second stud, the connector comprising an elevation, a pair of side flanges and a pair of terminal flanges, the side flanges extending from the elevation, the terminal flanges extending outwardly from the side flanges such that the terminal flanges are substantially parallel to the elevation;

attaching the elevation of the connector to the web of the first stud such that the elevation of the connector is flush with the web of the first stud; and attaching the terminal flanges of the connector to the web of the second stud such that the terminal flanges of the connector is flush with the web of the second stud, whereby the returns of the first stud are flush with the returns of the second stud.

10. The method of claim 9, wherein the elevation of the connector is attached to the web of the first stud by a screw, and the terminal flanges of the connector are attached to the web of the second stud by screws.

11. The method of claim 9, wherein the side flanges of the connector are substantially perpendicular to the flanges of the first stud when the first stud and the second stud are connected by the connector.

12. The method of claim 9, wherein the number of the connector needed for securing the first stud and the second stud is only one.

13. A method of providing a support for framing an opening, which comprises:

providing a first stud, a second stud, and a connector, the first stud comprising a web, a pair of flanges and a pair of returns, each of the flanges extending substantially perpendicularly from the web, the returns extending inwardly from the flanges such that the returns are substantially parallel to the web, the second stud comprising a web, a pair of flanges and a pair of returns, each of the flanges of the second stud extending substantially perpendicularly from the web of the second stud, the returns of the second stud extending inwardly from the flanges of the second stud such that the returns of the second stud are substantially parallel to the web of the second stud, the connector comprising an elevation, a pair of side flanges and a pair of terminal flanges, the side flanges extending from the elevation, the terminal flanges extending outwardly from the side flanges such that the terminal flanges are substantially parallel to the elevation;

attaching the elevation of the connector to the web of the first stud such that the elevation of the connector is flush with the web of the first stud;

attaching the terminal flanges of the connector to the web of the second stud such that the terminal flanges of the connector is flush with the web of the second stud, whereby the connector secures the first stud and the second stud together such that the returns of the first stud are flush with the returns of the second stud; and installing the first stud and the second stud secured by the connector inside a wall adjacent to the opening.

14. The method of claim 13, wherein the elevation of the connector is attached to the web of the first stud by a screw, and the terminal flanges of the connector are attached to the web of the second stud by screws.

15. The method of claim 13, wherein the side flanges of the connector are substantially perpendicular to the flanges of the first stud when the first stud and the second stud are connected by the connector.

16. The method of claim 13, wherein the side flanges of the connector extends outwardly diagonally from the elevation.

17. The method of claim 13, wherein the number of the connector needed for securing the first stud and the second stud is only one.

18. The method of claim 13, which further comprises locating the connector for securing the first stud and the second stud together at the point where a header is attached to one of the first stud and the second stud.

19. The method of claim 18, which further comprises attaching the header to the second stud.

* * * * *